United States Patent [19]

Kaneko

[11] 4,306,987

[45] Dec. 22, 1981

[54] LOW-FOAMING NONIONIC SURFACTANT FOR MACHINE DISHWASHING DETERGENT

[75] Inventor: Thomas M. Kaneko, Trenton, Mich.

[73] Assignee: BASF Wyandotte Corporation, Wyandotte, Mich.

[21] Appl. No.: 220,870

[22] Filed: Dec. 29, 1980

Related U.S. Application Data

[63] Continuation-in-part of Ser. No. 95,885, Nov. 19, 1979, abandoned.

[51] Int. Cl.[3] ..... C11D 1/722; C11D 3/075; C11D 3/395

[52] U.S. Cl. ..... 252/99; 252/102; 252/135; 252/174.21; 252/174.22; 252/321; 252/357; 252/358; 252/529; 252/548; 252/DIG. 1

[58] Field of Search ..... 252/99, 102, 135, 174.21, 252/174.22, 529, 548, 321, 357, 358

[56] References Cited

U.S. PATENT DOCUMENTS

| | | | |
|---|---|---|---|
| 3,314,891 | 4/1967 | Schmolka | 252/99 |
| 3,359,207 | 12/1967 | Kaneko | 252/99 |
| 3,630,923 | 12/1971 | Simmons | 252/99 |
| 3,635,827 | 1/1972 | Jakobi | 252/558 |
| 3,821,118 | 6/1974 | Finck | 252/99 |
| 3,888,781 | 6/1975 | Kingry | 252/99 |
| 4,127,496 | 11/1978 | Stokes | 252/102 |
| 4,244,832 | 1/1981 | Kaneko | 252/99 |
| 4,272,394 | 6/1981 | Kaneko | 252/99 |

FOREIGN PATENT DOCUMENTS 1325645 8/1973 United Kingdom .

OTHER PUBLICATIONS

"Preliminary Technical Data—TETRONIC R Polyol Series Nonionic Surfactants," Literature distributed by BASF Wyandotte, Sep., 1978.

*Primary Examiner*—Dennis L. Albrecht
*Attorney, Agent, or Firm*—Andrew E. Pierce

[57] ABSTRACT

Machine dishwashing detergents are disclosed containing a low-foaming nonionic surfactant having relatively low cloud point which unexpectedly provides effective detergency and foam control when utilized as the sole nonionic surfactant. Dishes and other utensils are cleaned to a sparkling clean spot-free condition by the machine dishwashing detergent compositions of the invention containing conventional phosphate builders or non-phosphate builders but excluding conventional alkyl phosphate ester defoaming agents. The machine dishwashing detergent compositions of the invention are effective on dishes and other utensils encrusted with soils comprising egg and other milk-derived protein soils.

11 Claims, No Drawings

LOW-FOAMING NONIONIC SURFACTANT FOR MACHINE DISHWASHING DETERGENT

CROSS-REFERENCE TO RELATED APPLICATIONS

This is a continuation-in-part of co-pending Application Ser. No. 095,885, filed Nov. 19, 1979, now abandoned.

BACKGROUND OF THE INVENTION

1. Field of the Invention

This invention relates to machine dishwashing detergent compositions and related processes.

2. Description of the Prior Art

In the art of cleaning compositions for use in cleaning hard surfaces, particularly the art of cleaning tableware and other food-soiled utensils in machine dishwashers, the problem of excessive foam buildup in the machine during operation as the result of high food soil concentrations has been largely solved by the use of alkyl phosphate ester defoamers such as monostearyl acid phosphate as disclosed in U.S. Pat. No. 3,314,891. Prior to such dislosure, machine dishwashing compositions had the tendency to foam excessively and/or leave undesirable spots and streaks on dishes and glassware. The low foaming nonionic surfactants contained in such detergent compositions were ineffective in both removing food soil and providing suitable foam control where the aqueous cleaning solution became contaminated with foam generating protein soils such as egg soil and soil from various milk products.

The generation of such foams is particularly insidious in that the cleaning action of the machine dishwasher depends to a large extent upon the effective suppression of foam generation during operation. Without effective foam suppression, the mechanical cleaning action of the machine dishwasher is reduced as the result of foam buildup in the aqueous cleaning solution so that the aqueous washing fluid which is normally impelled against the tableware in the machine dishwasher is less effective in cleaning because it is forced against the tableware at reduced pressure.

An indication of the various kinds of nonionic surfactants utilized in such machine dishwashing compositions can be found in the above patent and in U.S. Pat. No. 3,359,207. General disclosures of nonionic surfactants can be found in U.S. Pat. No. 2,677,700, U.S. Pat. No. 2,979,528, and U.S. Pat. No. 3,036,118. Low foaming washing and cleaning agents for use in machine dishwashing are also disclosed in U.S. Pat. No. 3,382,176. More recently, machine dishwashing detergent compositions containing a non-phosphate salt builder have been disclosed in British Pat. No. 1,325,645; Canadian Pat. No. 941,707; U.S. Pat. No. 3,899,436; U.S. Pat. No. 4,127,496; and U.S. Pat. No. 4,092,258.

Recently a new series of nonionic surfactants has been disclosed, certain members of which possess relatively low cloud points as measured in a one percent aqueous solution. Such surfactants are suggested for use in the formulation of machine dishwashing detergents and generally for use where a defoamer is necessary. These new nonionic surfactants are termed TETRONIC® R polyols and are produced by the sequential block polymerization of ethylene oxide and propylene oxide utilizing, as polymerization initiator, a propoxylated ethylenediamine sold under the trademark QUADROL®. The TETRONIC® polyols were introduced to the trade in September, 1978.

SUMMARY OF THE INVENTION

Detergents are disclosed for machine dishwashing which permit the elimination of the conventionally used alkyl phosphate ester defoaming agents of the prior art. The machine dishwashing detergents of the invention are useful when formulated with builders of the phosphate or non-phosphate type. Because of the relatively low cloud point of the nonionic surfactant disclosed, the machine dishwashing detergents of the invention can be utilized over a wide range of operating conditions. Washwater temperatures as low as 100° F. and as high as 180° F. can be used.

The nonionic surfactant component of the detergent of the invention is prepared using an initiator which can include the nitrogen-based initiators of U.S. Pat. No. 2,979,528, incorporated herein by reference, but is more broadly defined to include other initiators (1) having about 2 to about 6 carbon atoms and at least 2, preferably 2 to about 6, active hydrogen atoms or (2) having about 6 to about 18 carbon atoms, preferably about 9 to about 11 carbon atoms and at least one active hydrogen atom, preferably about 1 to about 6 active hydrogen atoms. For instance, hexyl alcohol, octyl alcohol, stearyl alcohol, ethylene diamine, triethylene diamine, hexamethylene diamine and the like, ethylene glycol, propylene glycol, trimethylol propane, pentaerythritol, and erythritol can be utilized as initiators. The nonionic surfactants have a relatively low cloud point (1 percent by weight aqueous solution).

One significant difference between the surfactants of U.S. Pat. No. 2,979,528 and those used herein is the sequence in which the block polymer is formed of hydrophilic and hydrophobic alkylene oxides. The conjugated polyoxyethylene-polyoxypropylene block copolymers can be prepared in much the same way as the polymers of U.S. Pat. No. 3,036,118 by first oxyethylating an initiator compound and subsequently oxypropylating the resulting compound to produce the non-ionic surface-active agent, as more completely described in U.S. Pat. No. 3,036,118, incorporated herein by reference.

Useful polyoxyalkylene surfactants having a cloud point in a 1 weight percent aqueous solution of about 10° C. to about 30° C. have the formulas:

$$Y[(EO/A)_n(A)_mH]_x \quad \text{I}$$

$$Y[(A)_o(EO)_m(A)_nH]_x \quad \text{II}$$

$$Y[(A)_o(EO/A)_m(A)_nH]_x \quad \text{III}$$

$$Y[(EO/A)_m(EO/A)_n)H]_x \quad \text{IV}$$

wherein EO represents ethylene oxide which is present in the surfactant polymer in the proportion of about 5 to about 60 percent, preferably about 5 to about 25 percent, and most preferably about 5 to about 15 percent by weight; Y represents the nucleus of an active hydrogen-containing organic compound having a functionality x and (1) about 2 to about 6 carbon atoms and at least two reactive hydrogen atoms or (2) about 6 to about 18 carbon atoms and at least one reactive hydrogen atom; A represents a lower alkylene oxide selected from the group consisting of propylene oxide, butylene oxide, tetrahydrofuran or mixtures thereof; EO/A represents a mixture of ethylene oxide and a lower alkylene oxide in which EO and A are present in the proportions by weight of 5 to 95 to 95 to 5 percent; wherein up to 25 percent by weight of A is reacted directly with said organic compound either alone in formulas II and III or in admixture with ethylene oxide in the formulas I and IV, and 75 percent by weight or more of A is subsequently reacted to produce said polymer; m, n and o are integers individually selected such that said polymer has an average total molecular weight generally of about 500 to about 25,000.

Other polyoxyalkylene surfactants having a cloud point in a 1 weight percent aqueous solution of about 10° C. to about 20° C. and preferably about 15° C. to about 20° C., are also useful in blends with conventional low-foaming nonionic surfactants. These have the formula:

$$Y[(EO)_m(A)_nH]_x \qquad V$$

where Y, EO, A, m, n, x, molecular weight and useful proportions are defined herein for formulas I-IV.

It has been found that certain of these so-called "reverse" polyoxyalkylene block copolymers as defined above, are particularly suitable both as wetting agents and as defoaming agents for proteinaceous soils encountered in machine dishwashing. Useful surfactant compositions result where the proportion of ethylene oxide utilized is about 5 to about 60 percent, preferably about 5 to about 25 percent by weight of the polymer and the total molecular weight of the polymer is about 500 to about 25,000, preferably about 1500 to about 20,000, and most preferably about 2500 to about 10,000. Especially preferred are such polymers prepared using an initiator compound characterized as an organic compound having 2 to about 6 carbon atoms and at least two reactive hydrogen atoms, most preferably, 4 to about 6 reactive hydrogen atoms and 2 nitrogen atoms. Representative useful initiators, besides those listed above, include diethylene triamine, triethylene tetramine, and tetraethylene pentamine.

THE BUILDER SALTS

The automatic dishwashing detergents to which surfactant compositions of the invention are added in order to reduce foaming of aqueous solutions thereof in the presence of raw egg soil generally contain 20 to 80 weight percent of an alkaline condensed phosphate salt such as tetrasodium pyrophosphate and those polyphosphates of the calcium and magnesium ion sequestering type whose $Na_2O/P_2O_5$ ratios range from 1:1 to 1.67:1 and 20 to 80 weight percent of an alkaline detergent salt such as sodium carbonate, sodium bicarbonate and mixtures thereof, di- and trisodium orthophosphate, sodium metasilicate, sodium sequisilicate, borax and sodium borate. In addition, these detergents often include 5 to 50 weight percent chlorinated trisodium phosphate. A mixture of lithium hypochlorite or chlorinated cyanuric acid and trisodium phosphate can be used in place of chlorinated trisodium phosphate. An automatic dishwashing detergent of this type can be prepared by adding an aqueous silicate solution to substantially anhydrous sodium tripolyphosphate and subsequently adding chlorinated trisodium phosphate thereto under the conditions as described in U.S. Pat. No. 3,359,207, incorporated herein by reference.

Highly alkaline dishwashing detergents containing no silicates can attack, etch, and darken aluminum utensils. Some of these formulations also have a destructive action on over-the-glaze dish patterns. Suitable proportions of silicates in the dishwashing formulations help overcome these difficulties. The silicate used in the compositions of the present invention is preferably solid granular sodium metasilicate, a commercially available material. In the broader aspects of the invention, sodium silicates in which the mole ratio of $SiO_2$:$Na_2O$ are more than 1:1, e.g., 2:1 or 3:2:1, may be used in place of the sodium metasilicate. The sodium silicate generally constitutes from about 20 percent to about 80 percent of the final composition and preferably from about 20 percent to about 40 percent.

Organic sequestering agents can be used in the detergent compositions of the present invention in place of inorganic phosphate salts. Suitable sequestering agents include the various aminocarboxylates, including ethylenediamine tetraacetates (soluble salts, e.g., Na, K, etc.), nitrilotriacetates, and the like.

Alternatively to the use of phosphate builders, any of the water-soluble metal salts of citric acid can be used in the practice of the present invention. However, all salts do not serve with equal effectiveness, and the alkali metal salts, particularly the sodium and potassium citrates, are preferred. There are three COOH radicals on the citric acid molecule. Commercial "sodium citrate" is fully neutralized and is more accurately described as trisodium citrate. Trisodium citrate is available as white crystals or granular powder. It is odorless, stable in air, and has a pleasant saline taste. Each molecule of trisodium citrate dihydrate loses two molecules of water of hydration when heated to 150° C. Commercial potassium citrate also exists as white crystals or powder. It is normally available as the monohydrate (as contrasted to sodium citrate which exists as the dihydrate).

As used in the present invention, the amount of citrate employed will be within the range of 20 to 80 weight percent on a dry basis (expressed as trisodium citrate). Water of hydration can be considered to be part of the salt. More usually, the amount of citrate (whether hydrated or not) employed will be from 20 to 40 weight percent.

If desired, mixtures of citrates can be used. Although it is not preferred, a citrate can be formed in situ from, for example, the combination of citric acid with sodium or potassium hydroxide. The use of a pre-formed alkali metal citrate or a mixture thereof is particularly preferred with dry blended solid detergents.

The combination of the citrate and the condensed phosphate salt (e.g., sodium tripolyphosphate) appears to result in enhanced activity, and the total of the citrate and the condensed phosphate salt will be in the range of 20 to 80 weight percent on a dry basis and will generally not exceed 65 weight percent (dry basis) of the total composition. Excellent results can be obtained from the combination of sodium tripolyphosphate and sodium citrate when the ratio on a dry weight basis of polyphosphate to citrate is less than about 2:1 but greater than about 0.05:1, i.e., 1:2 to 20:1 citrate:- polyphosphate. One method for formulating a detergent composition of this invention is to modify the machine dishwashing detergent formula by replacing more than one-third of the condensed phosphate salt with citrate; provided, of course, that the condensed phosphate content is reduced below 35 percent on a dry weight basis.

Although the alkali metal citrates can be chelating agents and are known to have some water conditioning effects, these compounds are not particularly effective sequestering agents at alkaline pH levels. Nor are the citrates themselves known to be particularly outstanding in performing the variety of functions, in addition to sequestering attributed to sodium tripolyphosphate (buffering, de-flocculation, solubilizing or peptizing, etc.).

However, one-third, one-half, or even nine-tenths or more of the polyphosphate can be replaced by citrate with little or no significant loss in overall performance characteristics of the detergent composition. Although this invention is not bound by any theory, it appears that so long as sufficient condensed alkali metal phosphate is present to maintain a threshold effect, the citrate is an effective substitute for the remainder of the polyphosphate that would normally be present in a machine dishwashing detergent. However, partial replacement of condensed alkali metal phosphate with other carboxylic acid salt water conditioning agents (e.g., gluconate salts) does not appear to provide the same performance as the partial replacement with citrates.

When citrates are formed in situ from citric acid in compositions of the present invention, either solid or dissolved citric acid can be used. Commercially available aqueous citric acid solutions at concentrations of about 25 to 40 percent by weight are suitable.

THE CHLORINE RELEASING AGENTS

Another ingredient of the detergent compositions of this invention is an active chlorine-containing compound. The active chlorine-containing compound imparts germicidal and bleaching action to the detergent compositions. Active chlorine-containing compounds which may be employed in accordance with this invention include chlorinated trisodium phosphate, trichlorocyanuric acid, sodium salt of dichlorocyanuric acid, potassium salt of dichlorocyanuric acid, sodium hypochlorite and 1,3-dichloro-5,5-dimethylhydantoin. Based on 100 parts of detergent composition, 5 to 50 parts of active chlorine-containing compound may be employed. If chlorinated trisodium phosphate is employed, then from 10 to 25 parts of the chlorine compound are preferred since the amount of chlorine available in chlorinated trisodium phosphate is only 0.325 part per part of compound. Much higher amounts of chlorine are available in the chlorinated cyanuric acids and, therefore, when they are employed from five to ten parts of active chlorine compound are preferred.

TEST METHODS

The foam characteristics of the detergent compositions were measured by observing the rate of rotation of the perforated spray arm of an automatic dishwashing machine during the washing cycle in which raw egg soil and/or milk soil and detergent were present in definitive quantities. The rate of rotation of the spray arm is, of course, inversely proportional to the amount of foam present. In each of the subsequent examples, foam evaluation was carried out in a Hobart Kitchen Aid dishwasher. The procedure followed was to turn on the machine and, after part of the water had been added, turn off the machine and add the detergent composition and additives, if any, and 15 cc. of raw egg and/or 15 grams milk soil. The dishwasher was then turned on again and the balance of the water added. The water was at a temperature of about 120° F. or about 140° F. After the washing cycle started, the rate of rotation of the perforated spray arm was measured from the first to the second minute and from the third to the fourth minute. In the presence of excess foam, the rotor arm stopped or the foam overflowed. A spray arm rotation of about 70 r.p.m. or more is indicative that foam formation is being subsequently depressed.

A more extensive method of evaluation of dishwashing detergents and surfactants was also used in which foam control, as well as spotting and streaking, were evaluated. The test procedure used was as follows:

Detergent Formulation Used in Evaluating Surfactants

A. Composition

| Raw Materials | % by Wt. |
|---|---|
| Surfactant | 6 |
| Tetrasodium ethylenediamine tetraacetate | 49 |
| Sodium carbonate | 40 |
| Sodium trichloroisocyanurate | 5 |

B. Mixing Procedure

To achieve maximum chlorine stability of the formulated detergent, the following process of mixing the raw materials is used:

1. Spray a mixture of the surfactant onto the tetrasodium ethylenediamine tetraacetate (alone or mixed with other anhydrous inorganic builders) while continuously mixing, whereby hydration and simultaneous absorption of the surfactant occur.
2. Add the sodium carbonate while mixing.
3. Add the chlorine-containing compound to the mixture and continue mixing until homogenized and a dry, free-flowing, granular product is obtained.

Milk and Egg Soil Foam Control Evaluation

To study the effects of milk and egg solid upon the foam control performance of a dishwasher detergent, these tests are used under the following conditions. Further details are found in I. R. Schmolka and T. M. Kaneko, "Protein Soil Defoaming in Machine Dishwashers", *J. Am. Oil Chemists' Soc.*, 45, No. 8, pp. 563–566 (1968), incorporated herein by reference.

Dishwasher: KitchenAid, Model KD-12, equipped with electric counter for determining the RPM of the spray arm and a dial thermometer, mounted on the upper rack, for reading the wash solution temperature.

Materials:

Milk soil—12 g. powdered milk.

Egg soil—15 ml. stirred, raw whole egg.

Detergent—20 grams.

Procedure

1. The dishwasher is allowed to run 3 or 4 cycles, or until the desired operating temperature is indicated by the thermometer.
2. The test is started, after the dishwasher has completed filling with water for the main washing stage and the spray has started rotating, by opening the door and adding the soil (milk or egg as the case may be) and detergent.
3. As the door is closed, the electric counter, which indicates the number of revolutions made by the spray arm, is turned on and the stop watch is started.
4. The revolution per minute (RPM) of the spray arm for and 2nd and 4th minutes of the wash stage are recorded. The average of the two is used as the reading for the test. The readings, in RPM, are inversely proportional to the amount of foam produced. Hence, the higher the reading, the better the milk, or egg, soil foam control of the detergent. Since the effectiveness of the detergent is dependent upon the wash solution temperature, the latter is recorded with the corresponding average RPM, at 80°, 100°, and 120° F.

5. As an indication of overall performance of the detergent, the RPM's for the three soil conditions over the entire temperature range are added together to obtain a *total* RPM which is rated according to the following:

E (excellent), 625 or higher RPM
VG (very good), 600–624 RPM
G (good), 575–599 RPM
F (fair), 550–574 RPM
P (poor), 549 or lower RPM Spotting and Streaking Evaluation 1. Prepare five drinking glasses, e.g., 10 fluid ounce size of 2½" diameter×5'⅛" high, by thorough washing, drying and inspection to assure completely spot- and streak-free starting conditions. NOTE: The use of a "black box" which is constructed with fluorescent lights to give edge lighting of the glasses, is made for critical examination for spots and streaks.

2. Place the five glasses in the upper rack of the dishwasher, keeping note of the positioning of each glass. In subsequent washing cycles of this test, the glasses are rotated in position to eliminate spray-pattern effects of the dishwasher. In the bottom rack, to simulate home use conditions, place 6 nine-inch chinaware plates and 6 nine-inch melamine-formaldehyde ware plates in alternate positions, and place 6 knives, 6 forks and 6 teaspoons in the separate holder.

3. At the start of the main wash stage of the dishwashing cycle, add 20 g. of the detergent being tested and operate the dishwasher at 140° F. NOTE: Prior to starting the test, the dishwasher should be run two or three cycles to assure constant operating temperature.

4. This test is run for three consecutive cycles, while evaluating the glasses after each cycle, and using the following conditions:

1st cycle—no soil is used with the detergent.
2nd cycle—12 g. powdered milk is added together with the detergent.
3rd cycle—15 ml. stirred, raw whole egg is added together with the detergent.

5. Each of the drinking glasses is rated from 1.0 to 10.0, covering the range of perfectly free to completely covered with spots, streaks and/or haze. These effects are cumulative, as the testing is continued. Hence, the rating after the third cycle represents the overall performance of the detergent, which is rated as follows:

E (excellent), 1.0–1.9
VG (very good), 2.0–2.9
G (good), 3.0–3.9
F (fair), 4.0–4.9
P (poor), 5.0 or higher The following examples illustrate the various aspects of the invention but are not intended to limit its scope. Where not otherwise specified through this specification and claims, temperatures are given in degrees centrigrade and parts, percentages, and proportions are by weight.

EXAMPLE 1

A machine dishwashing detergent was prepred containing 5 percent by weight of a block polyol having about 8000 molecular weight prepared by condensing a mixture of ethylene oxide and propylene oxide in the weight ratio of propylene oxide to ethylene oxide of 9:1 with the tetrafunctional initiator N,N,N',N'-tetrakis(2-hydroxypropyl)-ethylenediamine, 35 percent by weight tetrasodium pyrophosphate, 20 percent by weight sodium tripolyphosphate, 10 percent by weight sodium metasilicate pentahydrate, 20 percent by weight chlorinated trisodium phosphate, and 10 percent by weight water.

The detergent is prepared by blending an aqueous mixture of the surfactant with the phosphate ingredients. Thereafter, the sodium metalsiicate pentahydrate is added while the mixture is constantly mixing. Next, the detergent mixture is reduced to a 25 mesh particle size by screening. Chlorinated trisodium phosphate is next added to the screened mixture.

The dishwasher detergent prepared above was evaluated at a concentration of a 0.3 percent by weight in accordance with the abreviated test procedure described above utilizing an automatic dishwashing machine in which raw egg soil and milk soil were successively utilized in measured amounts. The test results indicate that, whether the water temperature is maintained at 120° F. or 140° F., the dishwashing detergent provides excellent performance as judged by foam control and cleaning action.

EXAMPLE 2

Example 1 was repeated except that the nonionic detergent had a molecular weight of about 5000. Similar excellent results were obtained in the abreviated test evaluation using a machine dishwasher.

EXAMPLES 3 and 4

Examples 1 and 2 were repeated utilizing a nonphosphate builder to replace the phosphate-containing builder of Examples 1 and 2. The detergent was prepared utilizing 5 percent by weight of the nonionic surfactant of Examples 1 or 2 in combination with 30 percent by weight sodium citrate, 20 percent by weight sodium carbonate, 4 percent by weight chlorinated cyanurate, 11 percent by weight water, and 30 percent by weight sodium metasilicate pentahydrate.

Evaluation of the dishwasher detergents prepared above in a machine dishwasher in accordance with the abreviated test procedure described above, utilizing dishes and utensils successively contaminated with either raw egg soil or milk soil and successive water temperatures of 120° F. and 140° F., resulted in a rating of excellent for the detergents prepared above.

Using a nonionic detergent disclosed as useful in a machine dishwashing detergent formulation claimed in U.S. Pat. No. 4,127,496, an evaluation of foam control and spotting and streaking was made in comparison with a detergent formulation of the invention.

EXAMPLE 5

(comparative example forming no part of this invention)

A detergent of the prior art was prepared by blending a nonionic surfactant of the prior art with ethylene diamine tetraacetate and sodium carbonate and then adding sodium trichloroisocyanurate. The nonionic surfactant of the prior art was the product obtained by the condensation of 3 moles of propylene oxide with the condensation product of one mole of a mixture of essentially straight chain, primary fatty alcohols in the $C_{12}$ to $C_{15}$ range with 6 moles of ethylene oxide. The composition of the dishwashing detergent in percent by weight was as follows:

| Component | % by Weight |
|---|---|
| Nonionic surfactant of prior art | 6 |
| Tetrasodium ethylenediamine tetraacetate | 49 |
| Sodium carbonate | 40 |
| Sodium trichloroisocyanurate | 5 |

EXAMPLE 6

Using the block polyol nonionic surfactant of Example 1, the dishwashing detergent of Example 5 was made up substituting for the nonionic surfactant of the prior art, the surfactant of Example 1.

Evaluation of the detergents of Examples 5 and 6, in accordance with the more extensive test method described above for foam control and spotting and streaking, resulted in a rating of 342 RPM for the detergent of Example 5 and 699 RPM for the detergent of Example 6 in the foam control test. In the spotting and streaking test, the detergent of Example 5 was rated poor while the detergent of Example 6 was rated excellent. Test results are shown in Tables I and II below.

TABLE I

Foam Control Evaluation

| Temperature and soil Conditions Each Cycle | Average Spray Arm Speed (RPM) Detergent of Example 5 | Detergent of Example 6 |
|---|---|---|
| 80° F. No soil | 34* | 68 |
| 80° F. Milk soil | 28* | 61 |
| 80° F. Egg soil | 27* | 62 |
| 100° F. No soil | 44* | 85 |
| 100° F. Milk soil | 36* | 83 |
| 100° F. Egg soil | 38* | 83 |
| 120° F. No soil | 47 | 86 |
| 120° F. Milk soil | 42* | 86 |
| 120° F. Egg soil | 46* | 85 |
| Total 9RPM) | 342 (Poor) | 699 (Excellent) |

*Excessive Foam

TABLE II

Glassware Spotting and Streaking (Subjective Rating: 1 = Excellent, 5 = Poor)

| Temperature and soil Conditions Each Cycle | | Detergent of Example 5 | Detergent of Example 6 |
|---|---|---|---|
| 140° F. | No soil | 1.5 | 1.0 |
| 140° F. | Milk soil | 1.8 | 1.1 |
| 140° F. | Egg soil | 3.0 | 1.2 |
| | Total | 6.3 (Poor) | 3.3 (Excellent) |

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

The embodiments of the invention in which an exclusive privilege or property is claimed are defined as follows:

1. A low-foaming alkaline machine dishwashing detergent composition devoid of alkyl phosphate ester consisting essentially of:

A. about 1 to about 10 percent by weight of a nonionic surfactant consisting essentially of (1) a nonionic surfactant characterized as a block or heteric/block polyoxyalkylene having a cloud point in a 1 weight percent aqueous solution of about 10° C. to about 30° C. selected from the group consisting of at least one of the polyoxyalkylenes having the formulas:

$$Y[(EO/A)_m(A)_nH]_x \quad \text{I}$$

$$Y[(A)_o(EO)_m(A)_nH]_x \quad \text{II}$$

$$Y[(A)_o(EO/A)_m(A)_nH]_x \quad \text{III}$$

$$Y[(EO/A)_m(EO/A)_nH]_x \quad \text{IV}$$

wherein EO represents ethylene oxide which is present in the polymer in the proportion of about 5 to about 60 percent by weight; Y represents the nucleus of an active hydrogen-containing organic compound having a functionality of x and (1) about 2 to about 6 carbon atoms and at least two reactive hydrogen atoms or (2) about 6 to about 18 carbon atoms and at least one reactive hydrogen atom; A represents a lower alkylene oxide selected from the group consisting of propylene oxide, butylene oxide, tetrahydrofuran or mixtures thereof wherein up to 25 percent by weight of A is reacted directly with said organic compound either alone in formulas II and III or in admixture with ethylene oxide in formulas I and IV and 75 percent by weight or more of A is subsequently reacted to produce said polymer; m, n and o are integers individually selected such that the average total molecular weight of the polymer is about 500 to about 25,000 or (2) a nonionic surfactant characterized as a block polyoxyalkylene having a cloud point of about 10° C. to about 20° C. selected from the group consisting of at least one of the polyoxyalkylenes having the formula:

$$Y[(EO)_m(A)_nH]_x \quad \text{V}$$

wherein Y, EO, A, m, n, x, molecular weight and useful proportions are as defined above;

B. about 20 to about 80 percent by weight of an alkaline detergent builder salt selected from at least one of the group consisting of sodium carbonate, sodium bicarbonate, disodium orthophosphate, trisodium orthosphosphate, sodium metasilicate, sodum sesquisilicate, sodium borate, sodium tetraborate, sodium aluminum silicate, and sodium bisulfate;

C. about 20 to about 80 percent by weight of (1) a water-soluble metallic salt or citric acid or an organic sequestering agent selected from the group consisting of at least one of tetrasodium ethylene diamine tetraacetate and nitrilotriacetic acid or (2) alternatively, an alkaline condensed phosphate salt selected from the group consisting of at least one of tetrasodium pyrophosphate and those polyphosphates of the calcium and magnesium ion sequestering type having $Na_2O/P_2O_5$ weight ratios ranging from 1:1 to 1.67:1 or alternatively (3) mixtures of (1) and (2); and D. about 5 to about 50 percent by weight of a compound containing active chlorine or available oxygen.

2. The composition of claim 1 wherein said nonionic surfactant is a low-foaming nonionic surfactant having a cloud point in a one percent by weight aqueous solution of about 15° C. to about 25° C. and the formula $$Y[(PO)_o(EO)_m(PO)_nH]_x$$

wherein Y is an active hydrogen-containing initiator having at least 3 active hydrogens, PO represents propylene oxide, the total proportion by weight of ethylene oxide in the polymer is about 5 to 15 percent by weight, x is an integer of 2 to 6, and the total molecular weight is about 1500 to about 20,000.

3. The composition of claim 2 wherein Y is an active hydrogen-compound containing 4 active hydrogens selected from the group consisting of ethylenediamine, triethylenediamine, hexamethylenediamine, pentaerythritol, erythritol and mixtures thereof and the total molecular weight is about 2500 to about 10,000.

4. The composition of claim 3 wherein Y is ethylenediamine and the total molecular weight is about 8000.

5. The composition of claim 1 wherein said detergent contains an alkaline condensed phosphate salt; and an active chlorine-containing compound selected from at least one of the group consisting of chlorinated trisodium phosphate, chlorinated cyanuric acid and alkali metal salts thereof, and 1,3-dichloro-5,5-dimethylhydantoin; and wherein said detergent additionally contains about 1 to about 20 percent by weight of water and about 1 to about 10 percent by weight of filler.

6. The composition of claim 5 wherein said surfactant is the low-foaming surfactant of claim 2.

7. The composition of claim 5 wherein said low-foaming nonionic surfactant is the surfactant of claim 3 or 4.

8. The process of washing food-soiled utensils in a machine dishwasher comprising contacting said utensils with an aqueous solution of about 0.2 to about 1 percent by weight of the detergent composition of claim 1 at a water temperature of about 100° F. to about 180° F.

9. The process of claim 8 wherein said food soil comprises egg and/or proteinaceous soil derived from milk products.

10. The process of claim 9 wherein said builder is a phosphate salt selected from the group consisting of tetrasodiumpyrophosphate and polyphosphates of the calcium and magnesium ion sequestering type whose $Na_2O/P_2O_5$ weight ratios range from 1:1 to 1.67:1 and said active chlorine-containing compound is selected from the group consisting of at least one of chlorinated trisodium phosphate, chlorinated cyanuric acid and the alkali metal salts thereof, and 1,3-dichloro-5,5-dimethylhydantoin.

11. The process of claim 10 wherein said low-foaming surfactant is the composition of claim 2, 3, or 4.

* * * * *